United States Patent [19]

Oxley

[11] 4,227,374

[45] Oct. 14, 1980

[54] METHODS AND MEANS FOR STORING ENERGY

[76] Inventor: Alan J. Oxley, Sheepstead Folly, Frilford Heath, Abingdon, Oxon OX13 6QG, England

[21] Appl. No.: 956,411

[22] Filed: Oct. 20, 1978

[51] Int. Cl.[3] ..... F01K 25/08

[52] U.S. Cl. ..... 60/651; 60/652; 60/659; 60/671

[58] Field of Search ..... 60/659, 652, 651, 671, 60/516

[56] References Cited

U.S. PATENT DOCUMENTS

| | | | |
|---|---|---|---|
| 2,605,610 | 8/1952 | Hermitte | 60/39.18 |
| 3,154,928 | 11/1964 | Harmens | 60/651 |
| 3,628,332 | 12/1971 | Kelmar | 60/648 |
| 3,681,609 | 8/1972 | Boese et al. | 60/671 |
| 4,106,581 | 8/1978 | West | 60/651 |

FOREIGN PATENT DOCUMENTS

| | | | |
|---|---|---|---|
| 27154 | of 1898 | United Kingdom | 60/659 |
| 703331 | 2/1954 | United Kingdom . | |

*Primary Examiner*—S. Clement Swisher

[57] ABSTRACT

A method is disclosed for storage of energy produced at a conventional power station and release of said energy when subsequently required. The method comprises using the energy to refrigerate and liquefy atmospheric nitrogen and oxygen, storing the liquid gases at substantially below atmospheric temperature and subsequently using cold liquid gas, in combination with a source of heat at or above atmospheric temperature, to drive a closed cycle heat engine and yield mechanical energy. Auxiliary open and closed cycle heat engines are added to yield further mechanical energy and so utilize the full energy potential of the cold liquid gases.

10 Claims, 2 Drawing Figures

METHODS AND MEANS FOR STORING ENERGY

BACKGROUND AND SUMMARY OF THE INVENTION

Electricity supply organisations prefer to operate generating stations at constant high output to make the best use of both plant and fuel. But consumer demand normally falls at night, so some short-term storage systems have been built to absorb energy at night and release it when demand is high during the day. For example, a reversible plant comprising motor/dynamo plus water pump/turbine can absorb electrical power by pumping water to a higher reservoir overnight, and generate hydroelectric power from the raised water next day. Very large volumes of water are needed for such systems and, for social and geological reasons, suitable sites are rare. An essential requirement of any practicable storage system is that a high proportion of the energy absorbed should be recoverable.

In this invention of improved means of energy storage, energy is absorbed by refrigerating and liquefying air, and liquid nitrogen and liquid oxygen, the main atmospheric constituents, are stored at temperatures considerably below atmospheric. The cold stored liquid gases are subsequently used, in conjunction with a source of heat at a higher temperature such as the atmosphere, to drive a heat engine and thus make energy available when required.

A cold liquid gas such as nitrogen or oxygen will not yield mechanical energy if quite isolated, but can do so in combination with a source of heat at a higher temperature. One such source is the atmosphere, in which a virtually infinite amount of ambient temperature heat is available at no cost. Two basically different methods may be employed.

(A) The cold liquid may be boiled, for example by blowing air over pipes containing it, thus producing cold gas which can be further warmed and pressurised by atmospheric heat and used to drive an open cycle engine such as a turbine, hence making mechanical energy available.

(B) Instead of passing atmospheric heat directly to the boiling liquid as in (A), the liquid may be cirulated around the "cold end" of a closed cycle "heat engine" with separate working fluid (such as a Stirling engine using trapped helium as working fluid), the engine "hot end" being held close to the atmospheric temperature by blowing air over it. Although in such circumstances no part of the engine will be at a temperature above atmospheric, it will run because of the difference of temperature between its "cold" and "hot" ends. Operation of the engine will deliver heat at a low temperature to boil the cold liquid, producing cold gas in the same quantity as in (A) which can likewise be warmed and used to drive a turbine and so make mechanical energy available. However, there is a big advantage in delivering heat for boiling the liquid via the closed cycle heat engine, because the engine yields additional mechanical energy (by virtue of its operation) in the very process of delivering the heat. The lower the temperature of the cold end of the engine the greater the amount of such energy, so to maximise its mechanical energy output the closed cycle engine should deliver heat at a temperature only marginally above that of the cold liquid (which is sufficient to promote boiling).

Thermodynamics shows that the closed cycle engine of (B) above yields about twice as much mechanical energy as the turbine, so that overall method (B) yields three times as much energy as method (A) from the same amount of liquid nitrogen or oxygen. (The extra mechanical energy comes from transforming more heat energy from the atmosphere). The quantitative distinction between methods (A) and (B) is crucially important to any practical large-scale energy storage system based on the invention, because a high proportion of the energy absorbed must be recovered. Moreover if "waste heat" at above atmospheric temperature is available, it is beneficial to use it (instead of the air-borne atmospheric heat assumed so far) for pressurising gas for the turbine and at the "hot end" of the closed cycle engine, because more mechanical energy will then be yielded per gallon of liquid gas supplied. The higher the temperature of the waste heat the greater will be the benefit of using it, but even very low grade waste heat (say at 15° C. above atmospheric temperature, which is useless for other purposes) can be usefully employed at the "hot end" of the closed cycle engine or in pressurising gas for the turbine. It is important to notice that the engine and turbine basically operate because of the cold gas supplied at substantially below atmospheric temperature, not because of any waste heat: by difinition, "waste" heat at a plant cannot be used on its own.

The invention employs a complete reversal of normal heat engine practice (in which the upper temperature is maintained substantially above atmospheric by burning fuel, and the lower kept close to atmospheric by cooling with air or water). Heat engines operating in this new reversed mode, with their "hot" and "cold" ends respectively at temperatures generally close to, and considerably below, atmospheric will often be termed "cold engines" in this Specification; and the cold gas required for operation of a cold engine will often be termed a "cold energy" source.

It is an object of this invention to provide a method for absorption of surplus energy output from an electricity generating station, for temporary storage of energy, and for making available for use when subsequently required a maximum proportion of the energy absorbed. It is a further object of the invention to separate oxygen from air and use it to improve combustion efficiency at an electricity generating station, as described later. The invention may be modified, by those skilled in the art, to provide a method for absorption and temporary storage of energy from sources other than normal electricity generating stations (for example, energy from windmills or arrays of solar power collectors) and for making available for subsequent use a maximum proportion of the energy absorbed. The invention may also be modified to release energy in a different form from that absorbed: for example, although an atomic power plant is too large to be fitted to a vehicle, it can be used to liquefy atmospheric nitrogen which can be stored and subsequently used as a cold energy source to drive a vehicle by means of a closed cycle cold engine or an open cycle turbine or piston engine.

BRIEF DESCRIPTION OF THE DRAWINGS

The invention will now be further described, by way of example only, with reference to the accompanying drawings, wherein.

DETAILED DESCRIPTION OF THE EMBODIMENT

Figure 1:
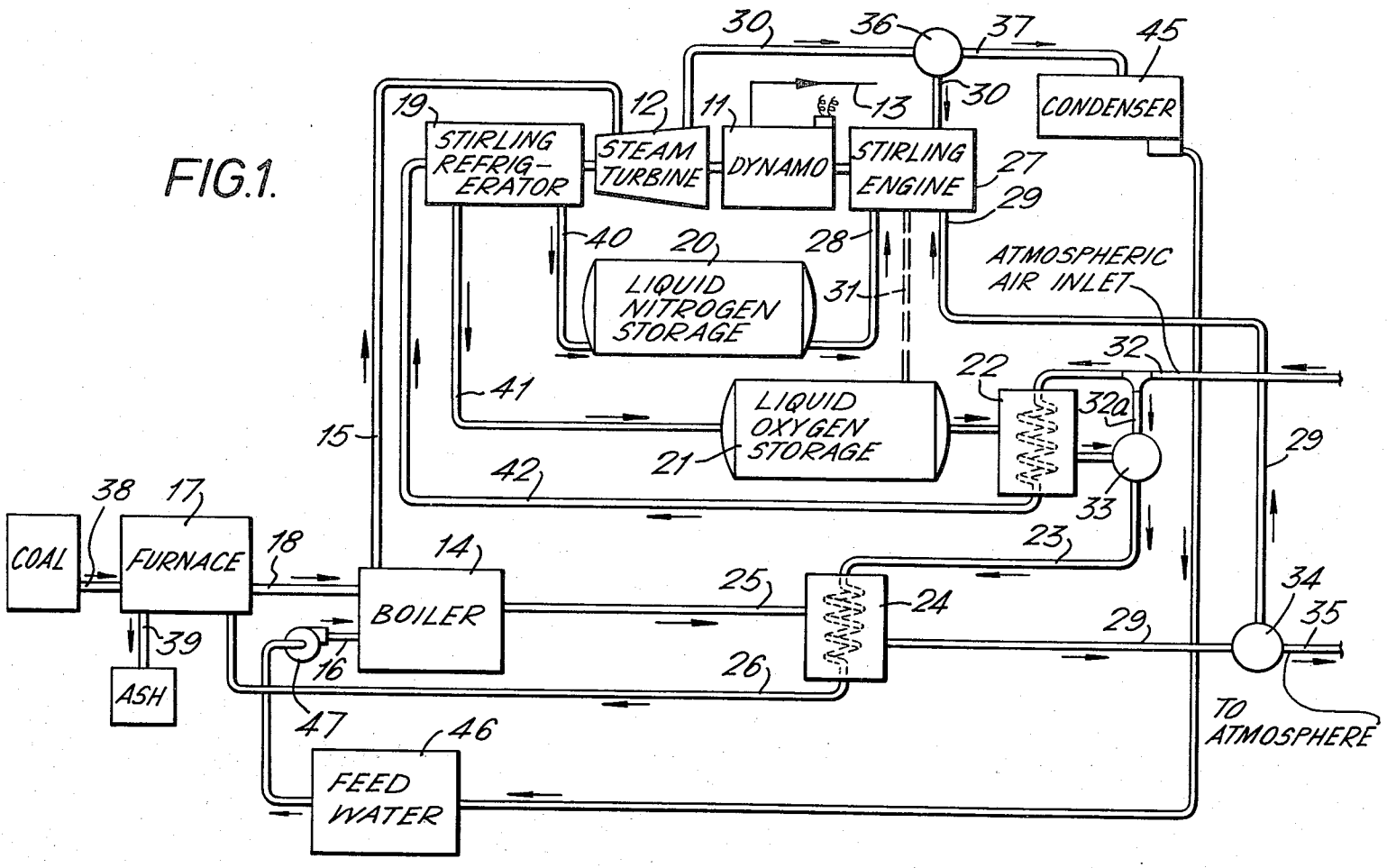
FIG. 1 is a schematic block diagram illustrating the layout of a conventional power station modified to incorporate the present invention.

With reference to FIG. 1, a dynamo 11 is driven by a steam turbine 12 so as to supply electricity to an output power line 13. The turbine 12 is driven by steam supplied from a boiler 14 through a supply line 15. Feed water is supplied to the boiler 14 through a supply line 16 and very hot gases of combustion from a furnace 17 are supplied to the boiler 14 through a supply line 18. The furnace 17 is provided with coal at 38 and ash is removed at 39.

During the night, when demand for electrical power is reduced substantially, the turbine 12 continues operating and supplies all necessary power to the dynamo 11. However, surplus power available from the turbine 12 is used to drive a Stirling refrigerator 19 which liquefies air. The main products of the liquefaction are liquid nitrogen and liquid oxygen, which liquefy at different temperatures (respectively −196° C. and −183° C.): they are thus separated in the refrigerator, which is designed for this purpose. Small quantities of rare gases such as argon and krypton which are also separated may be collected and sold.

The liquid nitrogen is discharged along a line 40 and is collected in a thermally-insulated storage tank 20 for use during the day. The liquid oxygen is discharged along a line 41 and collected in a thermally-insulated storage tank 21 but some liquid or cold oxygen gas is subsequently passed, via a heat exchanger 22 (where it cools atmospheric air coming in by way of an inlet line 32) to an interchange valve 33. The cooled air passes to the refrigerator 19 along a line 42 and is subsequently liquefied by the refrigerator. Atmospheric air for combustion purposes enters along the line 32 and a branch line **32*a* connected thereto and is mixed with oxygen (leaving the heat exchanger 22) at the interchange valve 33. The oxygen-enriched air flows along the supply line 23 to a heat exchanger 24 where it is first preheated by hot combustion gases passing from the boiler 14 through a supply line 25. The preheated air then flows by way of supply line 26 to the combustion chamber (not show) of furnace 17. Because oxygen enrichment is more important during the day, when the load on the station is at its heaviest, the storage take 21 is provided and oxygen gas may be drawn off therefrom during the day as required for the furnace 17**.

As the load on the dynamo 11 builds up at the beginning of the day, the refrigerator 19 is cut out and all the power from the turbine 12 is used to drive the dynamo 11. As the load increases further, a Stirling engine 27 is used to assist the turbine 12 in driving the dynamo 11. For this purpose, liquid nitrogen from the storage tank 20 is fed via supply line 28 to the cold end of the Stirling engine 27 and still-warm combustion gases and exhaust steam from the turbine are fed via supply lines 29 and 30, respectively, to the "hot" end of engine 27. Thus, in this example, the "hot" end of the Stirling engine 27 is kept above atmospheric temperature, but it would still assist in driving dynamo 11 if no part of the engine system were above atmospheric temperature. Even when its upper temperature is held above atmospheric by use of "waste heat" at the plant, it should be noted that power is output by engine 27 basically because the temperature at its cold end is substantially below atmospheric, at about −190° C. Without that low temperature, no use could be made of the "waste heat", which would just go to waste, as is normal practice. The exhaust steam and combustion gases arriving along lines 30 and 29 may be kept apart in separate compartments or by feeding their heat to the "hot" end of the engine 27 via separate heat pipes (not shown).

The process of evaporating oxygen from the storage tank 21, to enrich air going to the furnace or, if available in excess, to return to the atmosphere via a vent pipe (not shown), also employs a heat pipe 31 so that the "cold energy" of the liquid oxygen may be safely utilised at the cold end of the Stirling engine 27.

Furnace gases flowing along the line 29 from the heat exchanger 24 to the Stirling engine 27 can alternatively be exhausted to atmosphere by way of an interchange valve 34 and an exhaust line 35 connected thereto. Exhaust steam flowing from the turbine 12 by way of the line 30 can be employed at the "hot" end of the engine 27 or the steam can be discharged to a condenser 45 or a cooling tower (not shown) by way of an interchange valve 36 and exhaust line 37. Condensate is returned to the boiler 14 as feed water via a feed tank 46 and a feed pump 47. Other units (for example, flow control and/or isolating valves) may be incorporated in the system according to conventional practice but are not shown herein for reasons of clarity.

The overall effect at a power station or introducing the invention for energy storage is to smooth the load on the turbine and steam-generating parts of the system, to improve efficiency at the furnace by making oxygen-enriched air available, and to utilise some heat normally exhausted to the atmosphere. Moreover the turbine 12 and its related components need no longer be of a size sufficient for peak demand periods, because it is aided by the Stirling engine 27 at such times.

Consider a typical modern power station of 500 megawatts output which for eight hours overnight is not required to feed power to the National grid, thus making available some $4\times10^6$ kWh of electrical energy for liquefying air. Depending on refrigerator efficiency, this will produce about 8000 tonnes of liquid nitrogen and, separately, 2000 tonnes of oxygen. The production of liquid nitrogen in one night will occupy a volume of some 10,000 cubic metres in, say, four insulated tanks of $25\times10\times10$ meters. Such volumes can easily be stored locally, which is a considerable advantage over the pumped water storage schemes mentioned earlier, and subsequent use of the gases causes no pollution. During the period of peak demand next day, the liquefied gas is used to drive the Stirling engine 27 and hence the dynamo 11 to produce electrical power.

From the discussion in and following paragraph (B) above, it is clear that the closed cycle engine 27 can only convert to mechanical energy some two-thirds of the "cold energy" stored in the liquid nitrogen used at its cold end. The remainder resides in the cold gas vaporised from that liquid during operation of engine 27. It can be recovered by utilising the cold gas, and it is vital to do so for high overall thermodynamic efficiency of the power input—energy storge by liquefied gas—power output sequence. In detail, the cold vaporised gas may be collected and warmed to increase its pressure and enable it to do work in an open cycle engine such as a turbine: expansion in the turbine will cool the gas, which may be further warmed to raise its pressure to do work in another turbine, and so on. The heat source for warming the gas may be the atmosphere or any waste heat available at the plant: the heat should not be delivered directly (for example, by blowing air over pipes containing the cold gas) but at each stage via a closed cycle cold engine whose cold end temperature is not for above that of the cold gas. Operation of the closed cycle engine will then pass low temperature heat to the gas, thereby warming it for work in the turbine, and simultaneously yield mechanical energy (by virtue of operating). There is a definite and thermodynamically predictable limit to the amount of energy which can be derived from a gallon of liquid nitrogen, no matter how many stages of intermediate warming of the vaporised gas are used (though the actual amount depends on the temperature of atmospheric or waste heat used). The two-stage array of FIG. 2, now to be described, is a reasonable compromise between thermodynamic efficiency and capital cost.

Figure 2:
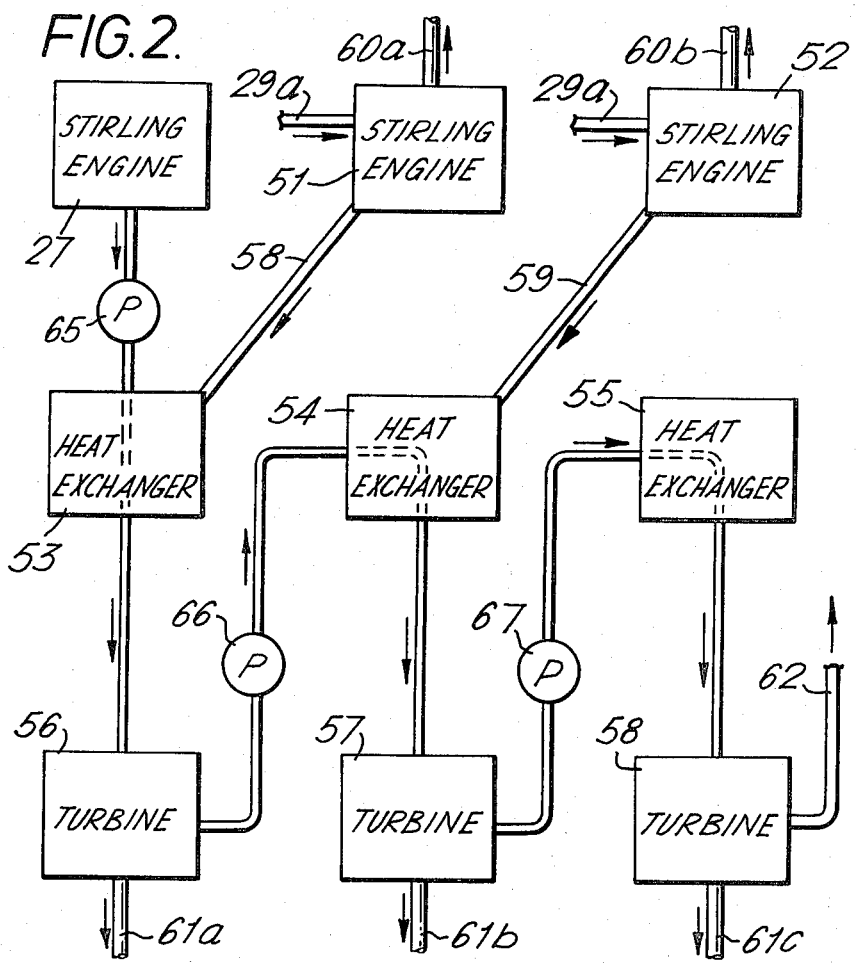
FIG. 2 is a schematic block diagram illustrating a modification of the invention, for recovering a higher proportion of the stored energy.

FIG. 2 shows the Stirling engine 27 of FIG. 1 and, by way of example only, two auxiliary Stirling cold engines (or other closed cycle engines with separate working fluid) 51 and 52, three heat exchangers 53, 54 and 55, and three turbines (or other open cycle engines) 56, 57 and 58. The "hot" ends of auxiliary engines 51, 52 receive "waste" heat via branch lines 29*a* of line 29 (FIG. 1) at somewhat above atmospheric temperature. "Waste" heat from steam rejected by the turbine 12 (FIG. 1) may also be used. Atmospheric or "waste" heat, as available, is similarly supplied to the heat-giving side of heat exchanger 55 via suitable pipes (not shown). The cold ends of auxiliary engines 51, 52 are connected to the heat exchangers 53, 54 by heat pipes 58, 59. Engines 51, 52 have mechanical power outputs 60*a*, 60*b*, and the expansion turbines have mechanical power outputs 61*a*, 61*b*, 61*c*. These mechanical power outputs are used (for example, to drive a dynamo) to assist the electrical output of the power station.

Nitrogen gas at about −196° C. leaves the cold end of the Stirling engine 27, where liquid nitrogen has been evaporated, and is passed by means of a pump 65 to the heat exchanger 53. It leaves the heat exchanger 53 at about −150° C. and increased pressure to pass through the turbine 56, where it expands and cools, yielding power output at 61*a*. It is then pumped by a pump 66 to heat exchanger 54, where its temperature is raised to about −75° C. and its pressure increased, and the pressurised gas is used to drive turbine 57 yielding power at 61*b*. The gas exhausted from turbine 57 is pumped to heat exchanger 55 by a pump 67, where its temperature is raised to about atmospheric and its pressure increased for driving the turbine 58. This yields power at 61*c* and the exhaust gas escapes to atmosphere along outlet line 62. It will be seen that the cold ends of auxiliary Stirling engines 51, 52 are at about −150° C. and −75° C. respectively. They deliver heat taken from the supply lines 29*a* to heat exchangers 53 and 54, automatically yielding power at 60*a*, 60*b* in the process of delivering the heat.

Including the Stirling engine 27, the system of FIG. 2 is intended, in daytime operation, to produce the maximum of power output per gallon of stored liquid gas (mainly nitrogen). To do so, the temperatures of −150° C. and −75° C. quoted above may be adjusted at a plant, and the heat sources for the "hot" ends of engines 27, 51, 52 and heat exchanger 55 rearranged in accordance with the quantities and temperatures of "waste" heat available from exhaust steam and spent combustion gases (with the shortfall drawn from the atmosphere, if the total quantity is otherwise insufficient). Once a relationship is established for each of engines 27, 51 and 52 between heat taken in at the "hot" end, heat given out at the cold end, the mechanical energy output and the temperatures at the two ends, and the characteristics of turbines 56, 57, 58 and heat exchangers 53, 54, 55 are known, it is possible to match the components shown in FIG. 2 for optimum overall performance.

As the Stirling cycle is reversible, the roles of refrigerator and cold engine, which are never needed simultaneously, may be filled by a single machine of suitable design. Thus during overnight periods when excess output from the generating station is being used to liquefy air, the auxiliary Stirling engines 51, 52 may be operated in reverse as auxiliary refrigerators for progressively cooling air prior to its liquefaction by Stirling refrigerator 19 (which may actually be engine 27 running in reverse, although shown separately in the block schematic diagram of FIG. 1). It is known that the thermodynamic efficiency of air liquefaction is improved by providing intermediate refrigeration at temperatures between atmospheric and the final liquefaction temperature.

It will be seen from FIGS. 1 and 2 and the description already given that the invention utilises a reversal of normal heat engine practice. A normal heat engine operates between high and ambient temperatures: power is only output because of the high temperature maintained, but a marginally improved performance (i.e. marginally more mechanical energy output per unit of fuel supplied) will be obtained at lower ambient temperature. Thus the turbine at a conventional power station benefits when the condenser temperature falls below its normal 35° C. or so, and would in principle benefit more if a plentiful supply of water at, say, 5° C. were available for cooling. But the new invention includes recovery of energy from stored cold liquid gas by operation of closed cycle cold engines between ambient (or somewhat higher) temperatures and others substantially lower, for example liquid nitrogen temperature. In this case power is only output because of the low temperature maintained, but an improved performance (i.e. more mechanical energy output per unit of cold nitrogen supplied) will be obtained at higher ambient temperature. Or in particular, if "waste" heat at, say, 35° C. is available it will boost the power output per unit quantity of liquid or cold gaseous nitrogen at no cost (except for piping, etc.), by definition of the word "waste".

A valuable bonus is won by using "waste" heat from the station. All stations presently dissipate a lot of heat, partly by exhausting combustion gases while still fairly hot into the atmosphere because it is not practicable to use the gases any further at the station. In a station incorporating the new invention it is advantageous to use these gases (instead of air) at the "hot" ends of the Stirling engines, and similarly utilise exhaust steam from the turbine 12 otherwise sent to a cooling tower. In this way the mechanical power output from a given quantity of liquid nitrogen may even be doubled. A further gain in overall efficiency arises from using for combustion purposes the considerable amounts of separated oxygen made availble by the invention. Higher temperatures may be achieved by burning fuel in oxygen-enriched air, thereby making for higher thermodynamic efficiencies, or the original temperature and efficiency may be obtained from lower grade fuel. The volume of still-hot exhaust combustion gases is reduced, and cleaner and more complete combustion, with less attendant pollution, is possible with oxygen enrichment.

I have described the principles of my invention and a specific embodiment in the foregoing text and FIGS. 1 and 2. But I wish it to be understood that within the scope of my claims, alternative embodiments are possible. Some alternatives are outlined below.

Although the invention has been described with reference to energy storage at a power station burning fossil fuel, it is not limited thereto but can be applied to other power-producing means such as atomic power stations (though the oxygen separated may not be needed on side in that case). By means of a local electric motor/dynamo, tanks for liquid gas and a Stirling refrigerator/engine, a similar scheme for energy storage overnight may be provided at factories, enabling electricity to be bought at cheaper overnight rates for use next day. The invention is particularly suitable for those factories which also require separated oxygen, and where "waste" heat is available during the day. As power can be produced from liquid gas by cold engines with no parts above atmospheric temperature, the invention can also be adapted for energy storage at sites such as isolated windmills, where no "waste" heat is available. The invention may also be modified for a gas other than nitrogen or oxygen, but the main atmospheric gases are preferred as being freely available from air (whereas an expensive gas would need daytime storage in the gaseous form), and for their low liquefaction temperatures (below the −118° C. critical temperature for oxygen) which lead to high "cold energies" per gallon.

If a worthwhile improvement in convenience or overall thermodynamic efficiency would be economically and satisfactorily achieved thereby:

(a) the series of open cycle turbines 56, 57, 58 should be changed in number, or replaced by a multi-stage turbine or other open cycle engine;

(b) the pair of auxiliary Stirling engines 51, 52 should be changed in number, or replaced by a multi-stage machine similar in principle to the Philips Stirling Cryogenic Transfer System PGH105; (c) an extra Stirling engine should be introduced alongside engine 27, with the cold ends maintained around −196° C. by liquid nitrogen for engine 27 and −183° C. by liquid oxygen for the extra engine: or engine 27 and the extra engine should be combined in a single multi-stage engine; (d) an alternative type of closed cycle cold engine or refrigerator should be substituted everywhere for the Stirling type, in either its conventional reciprocating version or in a rotary version such as the Zwiauer-Wankel described (with other details of Stirling machines, including the reversibility of the cycle) by G Walker in his book "Stirling Cycle Machines" (Oxford University Press, 1973).

I claim:

1. A plant including means for storing energy and subsequently releasing said energy when required, said means comprising:

refrigeration means, responsive to said energy, for refrigerating gas and liquefying said gas at substantially below atmospheric temperature;

storage means for storing said liquefied gas at substantially below atmospheric temperature;

a closed cycle heat engine having an upper temperature end and a lower temperature end; means for utilising said liquefied gas to maintain said lower temperature end at substantially below atmospheric temperature and means for maintaining said upper temperature end at not significantly below atmospheric temperature, thereby driving said heat engine and yielding mechanical energy, said engine including a working fluid independent of said liquefied gas.

2. The plant in claim 1 wherein said stored liquefied gas comprises nitrogen and oxygen in any proportions and is used to maintain said lower temperature end of said closed cycle heat engine at below −118° C.

3. The plant in claim 1 wherein means are provided to maintain said upper temperature end of said closed cycle heat engine at substantially atmospheric temperature.

4. The plant in claim 1 wherein said means for maintaining said upper temperature end of said closed cycle heat engine at not significantly below atmospheric temperature includes means for supplying waste heat available at said plant at above atmospheric temperature to said upper temperature end of said engine.

5. The plant in claim 1 wherein said closed cycle heat engine is a Stirling engine.

6. The plant in claim 1 wherein said closed cycle heat engine is designed so that its operation transfers heat from its lower temperature end to said liquefied gas at a temperature only slightly above that of the liquefied gas, thereby yielding a maximum of mechanical energy per unit quantity of liquefied gas supplied to said lower temperature end.

7. The plant in claim 1 wherein there is further provided:

means for collecting gas vaporised during operation of said closed cycle heat engine from said liquefied gas utilised to maintain said lower temperature end of said engine at substantially below atmospheric temperature;

a small number of additional auxiliary open cycle heat engines, such number being at least one;

means for passing said collected vaporised gas through each of said open cycle heat engines sequentially;

means for raising the temperature of said collected vaporised gas, thereby raising its pressure, before entering each said open cycle heat engine, thereby driving each said open cycle engine and yielding mechanical energy.

8. The plant in claim 7 wherein said means for raising the temperture of said collected vaporised gas before entering each said open cycle heat engine includes use of an additional auxiliary closed cycle heat engine with upper temperature end and lower temperature end and working fluid independent of said gas, each said auxiliary closed cycle engine being supplied at its upper temperature end with heat at a temperature not below atmospheric, including any waste heat available at said plant and not otherwise used therein, and designed so that its operation transfers heat from its lower temperature end to said gas at a temperature only slightly above the temerature at which said gas enters said open cycle engine.

9. The plant in claim 1 wherein there is further provided an additional prime mover for driving a dynamo for the production of electrical power.

10. A plant for producing electrical power, including:

prime mover means for driving a dynamo for the production of electrical power;

refrigeration means for producing liquid nitrogen and liquid oxygen gases from the atmosphere at temperatures substantially below atmospheric;

storage means for storing said liquid gases;

an additional Stirling heat engine of closed cycle form, employing a working fluid independent of said liquid gases, having an upper temperature end and a lower temperature end; means for transferring said liquid gases to said lower temperature end of said Stirling engine, thereby maintaining said end at a temperature below −118° C.;

means for supplying heat to said upper temperature end of said Stirling engine at above atmospheric temperature from any suitable waste heat available at said plant and not otherwise used therein, thereby driving said Stirling engine and yielding mechanical power for driving a dynamo to produce electricity;

means for collecting gas vaporised from said liquefied gases at said lower temperature end during operation of said Stirling engine;

means for heating said collected gas, thereby raising its pressure;

at least one additional auxiliary open cycle heat engine; means for using said pressurized collected vaporised gas to drive said open cycle engine to yield mechanical energy.

* * * * *